US011976884B2

(12) United States Patent
Liu et al.

(10) Patent No.: US 11,976,884 B2
(45) Date of Patent: May 7, 2024

(54) FLEXIBLE TWO-PHASE CONVERSION HEAT TRANSFER DEVICE

(71) Applicant: ASIA VITAL COMPONENTS (CHINA) CO., LTD., Shenzhen (CN)

(72) Inventors: Han-Min Liu, Shenzhen (CN); Xiao-Xiang Zhou, Shenzhen (CN); Shi-Lei Wei, Shenzhen (CN)

(73) Assignee: Asia Vital Components (China) Co., Ltd., Shenzhen (CN)

( * ) Notice: Subject to any disclaimer, the term of this patent is extended or adjusted under 35 U.S.C. 154(b) by 0 days.

(21) Appl. No.: 17/178,263

(22) Filed: Feb. 18, 2021

(65) Prior Publication Data

US 2022/0260320 A1 Aug. 18, 2022

(51) Int. Cl.
*F28D 15/02* (2006.01)
*F28D 15/04* (2006.01)

(52) U.S. Cl.
CPC ..... *F28D 15/0241* (2013.01); *F28D 15/0266* (2013.01); *F28D 15/04* (2013.01)

(58) Field of Classification Search
CPC . F16L 11/11; F16L 11/1185; B29L 2023/186; H02G 3/0468; B29D 23/18; F28D 15/0241; F28D 15/04; F28D 15/0266; F28F 1/08
See application file for complete search history.

(56) References Cited

U.S. PATENT DOCUMENTS

2005/0189727 A1* 9/2005 Smith ..... F25B 9/145 277/634
2017/0234625 A1* 8/2017 Inagaki ..... F28D 15/0241 165/104.26
2018/0031329 A1* 2/2018 Wang ..... G06F 1/203

FOREIGN PATENT DOCUMENTS

| | | |
|---|---|---|
| CN | 108225074 A | 6/2018 |
| JP | 2017-44401 A | 3/2017 |
| TW | M372460 | 1/2010 |
| TW | M583932 | 9/2019 |
| TW | M612661 | 6/2021 |

OTHER PUBLICATIONS

Search Report dated Aug. 3, 2020 issued by Taiwan Intellectual Property Office for counterpart application No. 110100624.

* cited by examiner

*Primary Examiner* — Tavia Sullens
*Assistant Examiner* — Khaled Ahmed Ali Al Samiri
(74) *Attorney, Agent, or Firm* — Brad J. Thorson; DeWitt LLP

(57) ABSTRACT

A flexible two-phase conversion heat transfer device includes a main body enclosing a chamber. A working liquid is received in the chamber. A capillary structure body is disposed in the chamber. The main body has at least one bellows section. The bellows section has multiple waved stripes. The waved stripes at least have a waved stripe feature including a waved stripe height or a waved stripe width or a waved stripe pitch between each two adjacent waved stripes. By means of the different waved stripe features, the main body is bendable by an angle ranging from 0-180 degrees without interference between the waved stripes.

7 Claims, 5 Drawing Sheets

FLEXIBLE TWO-PHASE CONVERSION HEAT TRANSFER DEVICE

BACKGROUND OF THE INVENTION

1. Field of the Invention

The present invention relates generally to a heat transfer device, and more particularly to a flexible two-phase conversion heat transfer device.

2. Description of the Related Art

The conventional flexible heat transfer device such as heat pipe has a heat insulation section made of a polymer material such as rubber tube. Two ends of the heat insulation section are respectively connected with an evaporation section and a condensation section. The main bodies of the evaporation section and the condensation section are made of copper tubes. The polymer material has the properties of heat resistance, large working temperature range, low gas permeability and good flexibility. However, when bent, the tube body of the heat insulation section made of the polymer material is apt to deform. As a result, the resistance against vapor-liquid circulation of the working liquid in the heat insulation section is increased. Moreover, the heat insulation section made of the polymer material has poor tolerance and action resistance so that the heat insulation section is easy to damage. Furthermore, the evaporation section, heat insulation section and condensation section of the heat pipe can be made of metal material. However, the properties of the metal material will limit the flexibility of the heat insulation section so that the heat pipe cannot be flexed or bent by a large angle.

It is therefore tried by the applicant to provide a flexible two-phase conversion heat transfer device, which is bendable by an angle ranging from 0-180 degrees.

SUMMARY OF THE INVENTION

It is therefore a primary object of the present invention to provide a flexible two-phase conversion heat transfer device including a main body. A bellows section is disposed on the main body. The bellows section has multiple waved stripes. Each waved stripe has a waved stripe height. The waved stripe heights are unequal to each other, whereby the main body is bendable by an angle ranging from 0-180 degrees without interference between the waved stripes.

It is a further object of the present invention to provide a flexible two-phase conversion heat transfer device including a main body. A bellows section is disposed on the main body. The bellows section has multiple waved stripes. Each waved stripe has a waved stripe width. The waved stripe widths are unequal to each other, whereby the main body is bendable by an angle ranging from 0-180 degrees without interference between the waved stripes.

It is still a further object of the present invention to provide a flexible two-phase conversion heat transfer device including a main body. A bellows section is disposed on the main body. The bellows section has multiple waved stripes. Each waved stripe has a waved stripe feature including a waved stripe height or a waved stripe width or a waved stripe pitch between each two adjacent waved stripes. By means of the different waved stripe features of the waved stripes, the bellows section of the main body is bendable by different angles without interference between the waved stripes.

To achieve the above and other objects, the flexible two-phase conversion heat transfer device of the present invention includes: a main body having at least one straight section and a bellows section, the bellows section including multiple waved stripes arranged at intervals, each waved stripe having a waved stripe bottom end and a waved stripe top end, the waved stripe bottom end being positioned in adjacency to an outer surface of the main body, the waved stripe top end being raised from the outer surface of the main body, a waved stripe height being defined between the waved stripe bottom end and the waved stripe top end, the waved stripe heights being unequal to each other; and a chamber enclosed in the main body. A working liquid is received in the chamber. A capillary structure body is disposed in the chamber.

Still to achieve the above and other objects, the flexible two-phase conversion heat transfer device of the present invention includes: a main body having at least one straight section and a bellows section, the bellows section including multiple waved stripes, the waved stripes being multiple continuous crimps formed on the main body as recessed/raised structures or wave peaks and wave troughs, which are alternately arranged, each waved stripe having a waved stripe width, the waved stripe widths being unequal to each other; and a chamber enclosed in the main body. A working liquid is received in the chamber. A capillary structure body is disposed in the chamber.

In the above flexible two-phase conversion heat transfer device, the chamber includes an evaporation section, a heat insulation section and a condensation section. The straight sections respectively correspond to the evaporation section and the condensation section. The bellows section corresponds to the heat insulation section.

In the above flexible two-phase conversion heat transfer device, a waved stripe pitch is defined between each two waved stripes. The waved stripe pitches are equal or unequal to each other.

In the above flexible two-phase conversion heat transfer device, the waved stripe heights are gradually increased from the middle of the bellows section to two sides thereof or gradually increased from a left side of the bellows section to a right side thereof or gradually increased from the right side of the bellows section to the left side thereof.

In the above flexible two-phase conversion heat transfer device, each waved stripes has a waved stripe width. The waved stripe widths of the waved stripes are equal or unequal to each other.

In the above flexible two-phase conversion heat transfer device, the waved stripe widths are gradually increased from the middle of the bellows section to two sides thereof.

In the above flexible two-phase conversion heat transfer device, the waved stripes are annular or spiral waved stripes.

In the above flexible two-phase conversion heat transfer device, the capillary structure body includes a first capillary section and a second capillary section. The first capillary section is positioned on the straight sections. The second capillary section is positioned on the bellows section. The first capillary section is in capillary connection with the second capillary section. The first capillary section is a sintered capillary structure, a woven capillary structure, a channeled capillary structure or a fiber capillary structure. The second capillary section is a mesh capillary structure or a braid capillary body.

In the above flexible two-phase conversion heat transfer device, the second capillary section has two ends respectively extending from the bellows section to the straight sections.

In the above flexible two-phase conversion heat transfer device, the main body is a heat pipe or a flat-plate heat pipe or a vapor chamber made of metal material.

In the above flexible two-phase conversion heat transfer device, each waved stripe has a waved stripe leftmost side and a waved stripe rightmost side. The waved stripe width is defined between the waved stripe leftmost side and the waved stripe rightmost side.

In the above flexible two-phase conversion heat transfer device, a waved stripe pitch is defined between each two adjacent waved stripes. The waved stripe pitches are equal or unequal to each other.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention provides a flexible two-phase conversion heat transfer device including a main body. The main body has a bellows section. The bellows section has multiple waved stripes arranged at intervals or continuously. Each waved stripe has a waved stripe feature including a waved stripe height or a waved stripe width or a waved stripe pitch. The waved stripe feature of each waved stripe is different from the waved stripe feature of the other waved stripe. For example, the waved stripe height of each waved stripe is unequal to the other and/or the waved stripe pitch of each waved stripe is equal to or unequal to the other and/or the waved stripe width of each waved stripe is unequal to the other. Accordingly, when the bellows section of the main body is bent by different curvatures, the waved stripes will not interfere with each other.

Figure 1A:
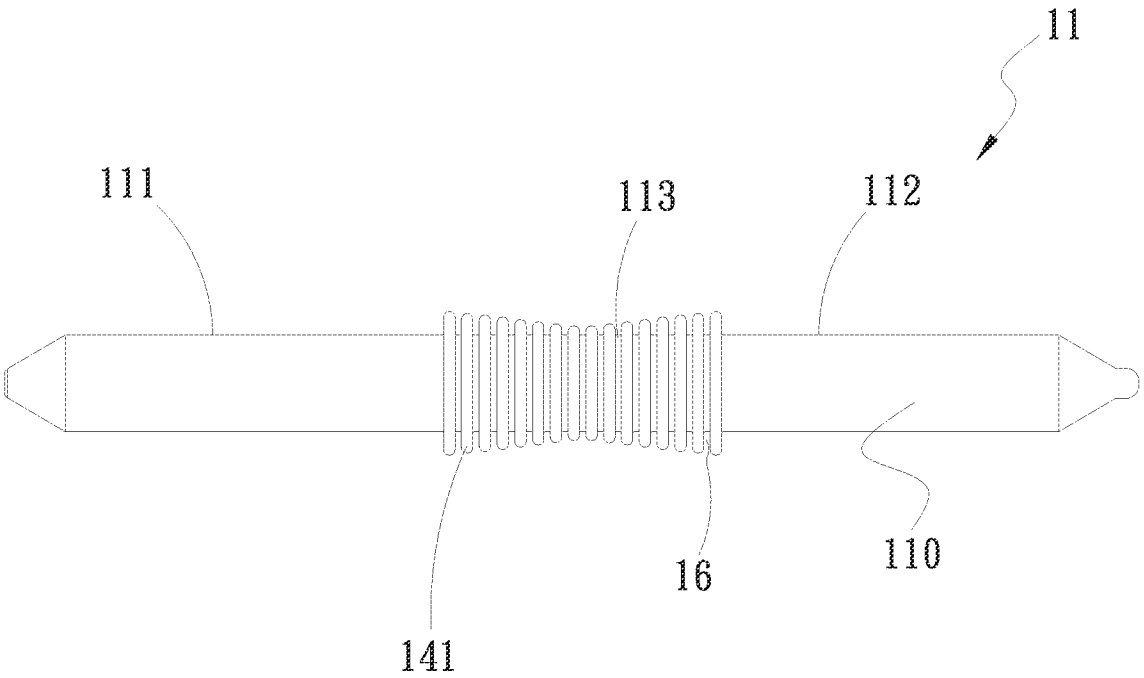
FIG. 1A is a front view of the flexible two-phase conversion heat transfer device of the present invention.
Figure 1B:
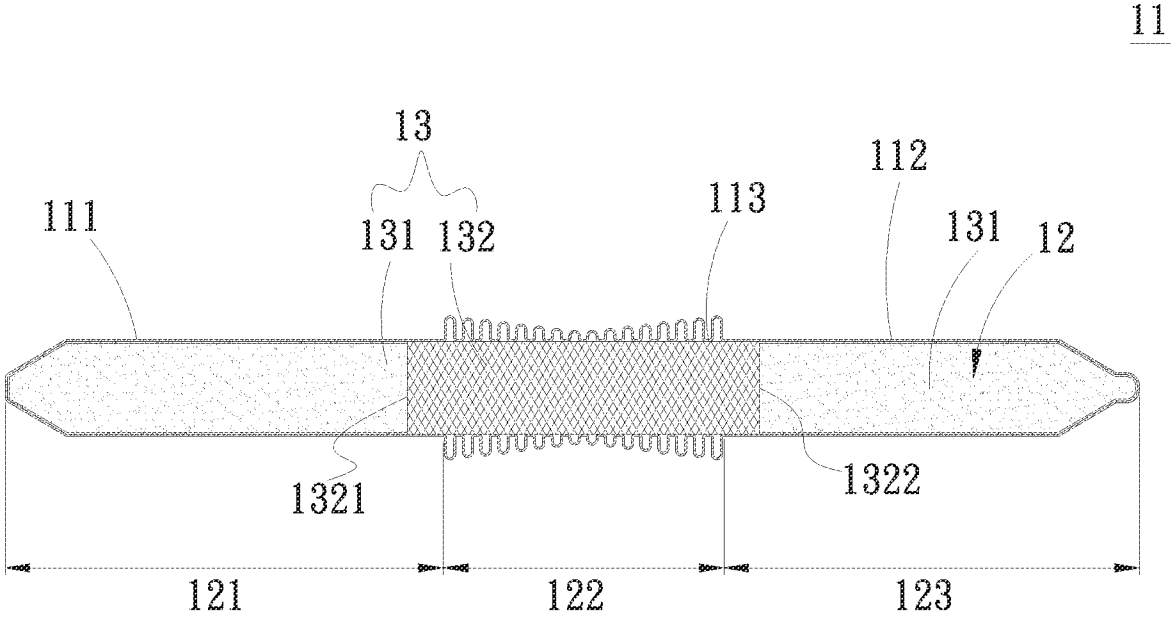
FIG. 1B is a sectional view of the flexible two-phase conversion heat transfer device of the present invention.

Please refer to FIGS. 1A and 1B. FIG. 1A is a front view of the flexible two-phase conversion heat transfer device of the present invention. FIG. 1B is a sectional view of the flexible two-phase conversion heat transfer device of the present invention. The flexible two-phase conversion heat transfer device of the present invention includes a main body 11, (which is such as, but not limited to, a non-flat-plate heat pipe (such as a circular heat pipe)). The main body 11 defines therein a chamber 12. A working liquid (not shown) is received in the chamber 12 and a capillary structure body 13 is disposed in the chamber 12. The chamber 12 is partitioned into an evaporation section 121, a heat insulation section 122 and a condensation section 123. The heat insulation section 122 is positioned between the evaporation section 121 and the condensation section 123. The capillary structure body 13 extends from the evaporation section 121 through the heat insulation section 122 to the condensation section 123. The working liquid is heated into vapor phase at the evaporation section 121 and then the vapor passes through the heat insulation section 122 to flow to the condensation section 123. Then the heat of the vapor is dissipated at the condensation section 123, whereby the vapor is converted into liquid phase, which goes back the evaporation section 121 under the capillary attraction of the capillary structure body 13.

The main body 11 has at least one straight section 111, 112 and a bellows section 113. In this embodiment, there are two straight sections 111, 112 respectively positioned on two sides of the bellows section 113. The straight sections 111, 112 respectively correspond to the evaporation section 121 and the condensation section 123. The bellows section 113 corresponds to the heat insulation section 122. The bellows section 113 includes multiple waved stripes 141, which are arranged at intervals. The waved stripes 141 are multiple continuous crimps or bends formed on the main body 11 as recessed/raised structures or wave peaks and wave troughs, which are alternately arranged.

Figure 2A:
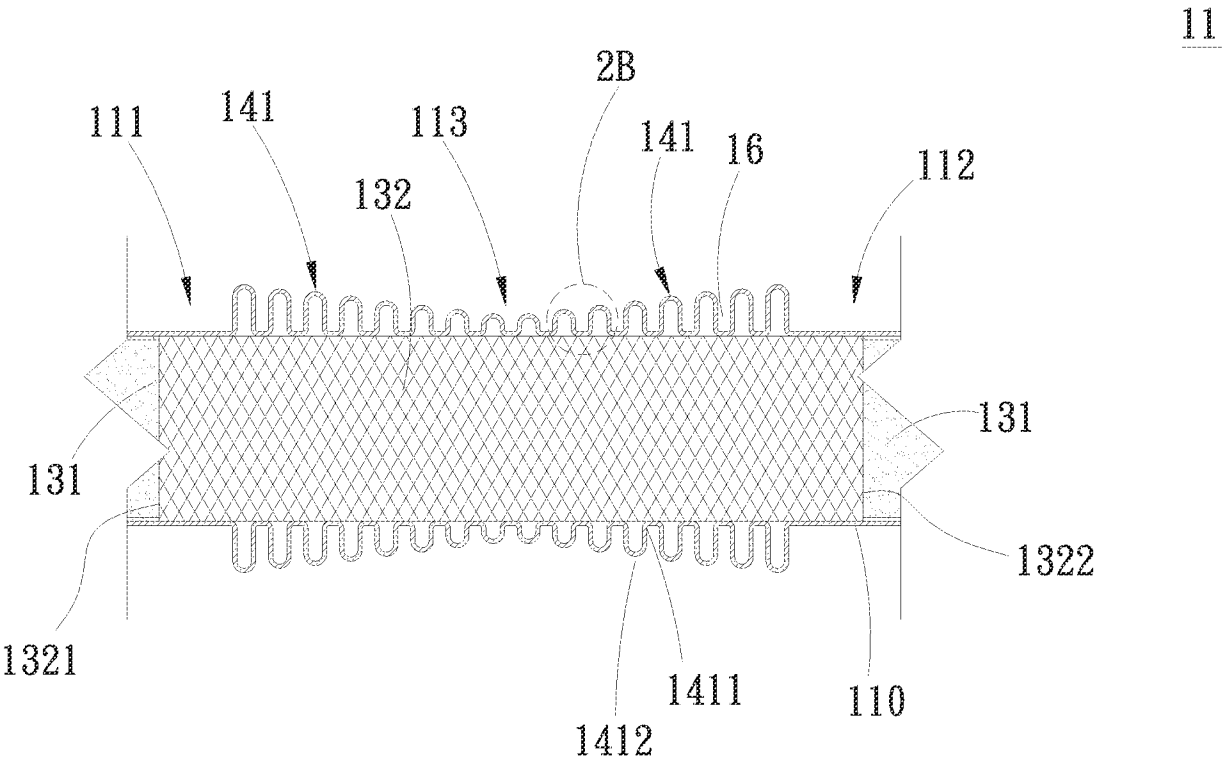
FIG. 2A is a partially sectional view showing a first embodiment of the capillary section of the bellows section of the flexible two-phase conversion heat transfer device of the present invention.
Figure 2B:
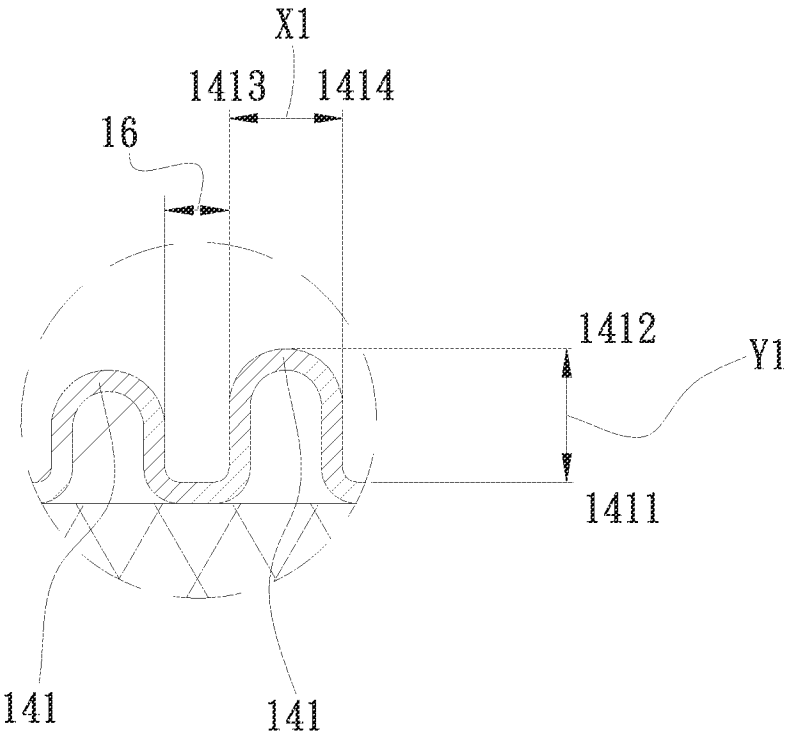
FIG. 2B is an enlarged view of circled area 2B of FIG. 2A.

Please now refer to FIGS. 2A and 2B. FIG. 2A is a partially sectional view showing a first embodiment of the capillary portion of the bellows section of the flexible two-phase conversion heat transfer device of the present invention. FIG. 2B is an enlarged view of circled area 2B of FIG. 2A. Also referring to FIGS. 1A and 1B, the capillary structure body 13 includes a first capillary section 131 positioned on the straight sections 111, 112 and a second capillary section 132 positioned on the bellows section 113. The first capillary section 131 is in capillary connection (or contact) with the second capillary section 132. The capillary connection means that the first and second capillary sections 131, 132 communicate with each other to transmit the capillary attraction to each other. In general, the first and second capillary sections 131, 132 are in capillary connection with each other by means of lap joint or mating or fusion.

The second capillary section 132 has two ends 1321, 1322 respectively extending from the bellows section 113 to the straight sections 111, 112. That is, the first capillary section 131 is disposed in the evaporation section 121 and the condensation section 123, while the second capillary section 132 is disposed in the heat insulation section 122. Two ends 1321, 1322 of the second capillary section 132 partially extend to the evaporation section 121 and the condensation section 123. The X-direction length of the second capillary section 132 is longer than the X-direction length of the bellows section 113.

The first capillary section 131 is such as, but not limited to, a sintered capillary structure. The second capillary section 132 is a woven capillary structure in adaptation to the bellows section 113 for requirement of flexibility. In this embodiment, the sintered capillary structure is such as sintered metal powder, while the woven capillary structure is such as a mesh capillary structure (longitudinal and latitudinal woven mesh body) as shown in FIGS. 1B and 2A. Alternatively, the first capillary section 131 can be such as a woven capillary structure or a channeled capillary structure or a fiber capillary structure. The second capillary section 132 is, but not limited to, a mesh capillary structure. Alternatively, the second capillary section 132 can be alternatively a braid capillary body. The braid capillary body is formed of multiple strands of bundles of fiber threads, which are woven and tangled with each other in the form of a braid, whereby the braid capillary body is a compact and solid capillary structure with better axial transfer ability and anti-flexion ability.

A waved stripe pitch 16 is defined between each two waved stripes 141. In this embodiment, the waved stripe pitches 16 are equal to each other, whereby the adjacent waved stripes 141 are arranged at equal intervals.

Moreover, as shown in FIG. 2B, each waved stripe 141 has a waved stripe bottom end 1411 and a waved stripe top end 1412. The waved stripe bottom end 1411 is positioned in adjacency to an outer surface 110 of the main body 11. (That is, the waved stripe bottom end 1411 is positioned on the same level as the outer surface 110 or positioned on a level higher/lower than the outer surface 110). The waved stripe top end 1412 is raised from the outer surface 110 of the main body 11. A waved stripe height Y1 is defined between the waved stripe bottom end 1411 and the waved stripe top end 1412.

Referring to FIG. 2A, in this embodiment, the waved stripe heights Y1 are unequal to each other. The waved stripe heights Y1 are gradually increased from the middle of the bellows section 113 to two sides thereof. That is, the waved stripe heights Y1 of the waved stripes 141 at the middle of the bellows section 113 are lower and the waved stripe heights Y1 of the waved stripes 141 on two sides of the bellows section 113 are gradually increased.

Please further refer to FIG. 2B. Each waved stripe 141 has a waved stripe leftmost side 1413 and a waved stripe rightmost side 1414. A waved stripe width X1 is defined between the waved stripe leftmost side 1413 and the waved stripe rightmost side 1414. In this embodiment, the waved stripe widths X1 of the waved stripes 141 are equal to each other.

Figure 3:
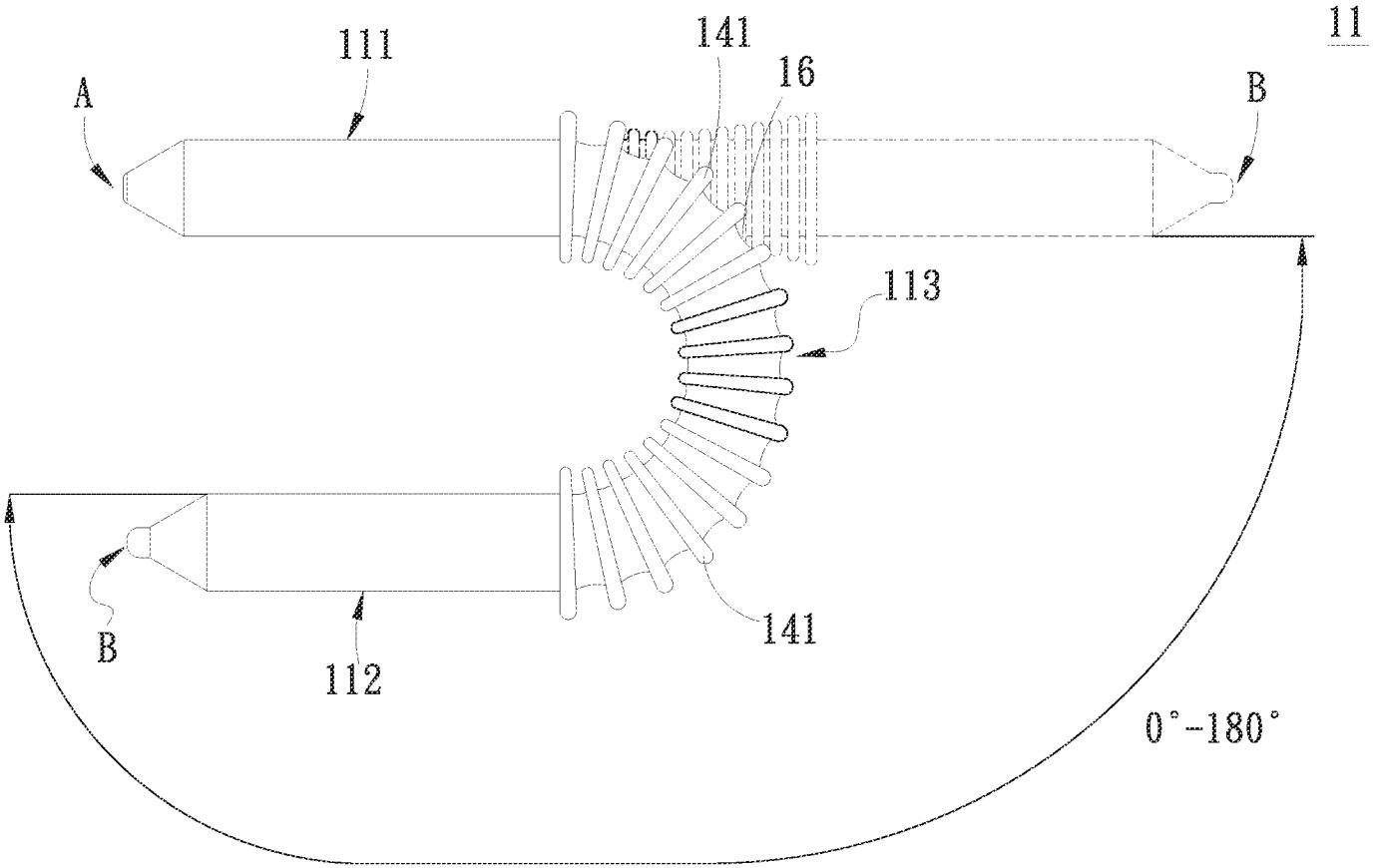
FIG. 3 is a view showing that the flexible two-phase conversion heat transfer device of the present invention is bent by an angle over 90 degrees.

Please further refer to FIG. 3, which is a view showing that the flexible two-phase conversion heat transfer device of the present invention is bent by an angle over 90 degrees. By means of the multiple waved stripes 141 of the bellows section 113, the main body 11 can be bent by an angle over 90 degrees, such as 180 degrees. The main body 11 has a leftmost end A and a rightmost end B. The rightmost end B is downward (or upward) bent from zero degree to 180 degrees to be parallel to the leftmost end A, whereby the main body 11 is bent from a horizontal straight tube into a U-shaped tube. The waved stripe heights Y1 of the waved stripes 141 at the middle of the bellows section 113 are lower than the waved stripe heights Y1 of the waved stripes 141 on two sides of the bellows section 113 so that when the main body 11 is bent, the multiple waved stripes 141 on the inner side of the bend of the main body 11 will not interfere with each other. Therefore, by means of the bellows section 113 of the main body 11, the main body 11 can be bent by an angle ranging from 0-180 degrees without interference between the waved stripes 141. This improves the problem that the bending angle of the bellows section is limited. Alternatively, the rightmost end B of the main body 11 can be, but not limited to, downward (or upward) bent by 90 degrees, whereby the main body 11 is bent from a horizontal straight tube into an L-shaped tube. Still alternatively, the leftmost end A of the main body 11 can be bent in the same manner to achieve the above bending state.

In a modified embodiment, the waved stripe heights Y1 of the waved stripes 141 are gradually increased from the left side of the bellows section 113 to the right side thereof. Alternatively, the waved stripe heights Y1 of the waved stripes 141 are gradually increased from the right side of the bellows section 113 to the left side thereof. Still alternatively, the waved stripes with higher waved stripe heights Y1 and the waved stripes with lower waved stripe heights Y1 are alternately arranged. The waved stripe pitches 16 between the waved stripes 141 are unequal to each other. For example, the waved stripe pitches 16 are increased or decreased from the middle of the bellows section 113 to two sides thereof. The waved stripe widths X1 are unequal to each other. For example, the waved stripe widths X1 are increased from the middle of the bellows section 113 to two sides thereof. Alternatively, the waved stripe heights Y1 of the waved stripes 141 are equal to each other, while the waved stripe widths X1 are unequal to each other. For example, the waved stripe widths X1 are increased from the middle of the bellows section 113 to two sides thereof.

Moreover, the waved stripes 141 are annular waved stripes (as shown in the drawings) or spiral waved stripes. The annular waved stripes 141 surround the main body 11 as closed loops. The spiral waved stripes surround the main body 11 in a spiral form. A helix angle is defined between each two adjacent waved stripes and all the waved stripes are connected via one spiral line.

Furthermore, the main body 11 of the present invention is a circular heat pipe, a flat-plate heat pipe or a vapor chamber. Also, the main body 11 is made of metal material such as pure metal (including aluminum, copper, titanium, etc.) or complex metal (alloy, including aluminum/magnesium alloy, copper/nickel alloy, aluminum/copper alloy, titanium alloy, etc.)

In the present invention, the waved stripe features of the waved stripes 141 are different from each other, whereby the main body 11 can be bent by an angle ranging from 0-180 degrees from a horizontal straight tube into a U-shaped tube or an L-shaped tube without interference between the waved stripes 141 on the inner side of the bend.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A flexible two-phase conversion heat transfer device comprising:

a main body having two straight sections and a bellows section located between the two straight sections, the bellows section including multiple waved stripes arranged at intervals, each waved stripe having a waved stripe bottom end and a waved stripe top end, each waved stripe bottom end being positioned in adjacency to an outer surface of the main body, each waved stripe top end being raised from the outer surface of the main body, a waved stripe height being defined for each waved stripe between the waved stripe bottom end and the waved stripe top end of each waved stripe, and the waved stripe heights gradually increase from the middle of the bellows section to two ends of the bellows section to form a difference of heights, so that the waved stripe heights are unequal to each other without interference between the waved stripes on an inner side of a bend, the bellows section having an equal or greater inner diameter than an outer diameter of either of the two straight sections; and a chamber enclosed in the main body, a working liquid being received in the chamber, a capillary structure body being disposed in the chamber, the capillary structure body including two first capillary sections and a second capillary section, each of the first capillary sections being positioned on the straight sections respectively, the second capillary section being positioned on the bellows section, wherein the bellows section enables one end of the main body to flex up to 180 degrees, towards the other end of the main body.

2. The flexible two-phase conversion heat transfer device as claimed in claim 1, wherein the chamber includes an evaporation section, a heat insulation section and a condensation section, the heat insulation section being positioned between the evaporation section and the condensation section, the straight sections respectively corresponding to the evaporation section and the condensation section, the bellows section corresponding to the heat insulation section.

3. The flexible two-phase conversion heat transfer device as claimed in claim 1, wherein a waved stripe pitch is defined between each two waved stripes, the waved stripe pitches being equal to each other.

4. The flexible two-phase conversion heat transfer device as claimed in claim 1, wherein each waved stripe has a waved stripe width, the waved stripe widths of the waved stripes being equal to each other.

5. The flexible two-phase conversion heat transfer device as claimed in claim 1, wherein the waved stripes are annular waved stripes.

6. The flexible two-phase conversion heat transfer device as claimed in claim 1, wherein the first capillary section is in capillary connection with the second capillary section.

7. The flexible two-phase conversion heat transfer device as claimed in claim 1 wherein the second capillary section has two ends respectively partially extending from the bellows section to the straight sections.

* * * * *